US008146255B2

(12) United States Patent
Denkert et al.

(10) Patent No.: US 8,146,255 B2
(45) Date of Patent: Apr. 3, 2012

(54) RAZOR BLADE UNIT WITH CUTTING EDGE SUPPORT

(75) Inventors: Uwe Denkert, Sonneberg (DE); Kai-Uwe Ruede, Oberwohlsbach (DE)

(73) Assignee: Feintechnik GmbH Eisfeld, Eisfeld (DE)

( * ) Notice: Subject to any disclaimer, the term of this patent is extended or adjusted under 35 U.S.C. 154(b) by 296 days.

(21) Appl. No.: 12/470,572

(22) Filed: May 22, 2009

(65) Prior Publication Data

US 2009/0288304 A1 Nov. 26, 2009

(30) Foreign Application Priority Data

May 22, 2008 (EP) ..... 08104068

(51) Int. Cl.
*B26B 21/16* (2006.01)

(52) U.S. Cl. ..... 30/50; 30/49

(58) Field of Classification Search ..... 30/48, 49, 30/50

See application file for complete search history.

(56) References Cited

U.S. PATENT DOCUMENTS

| | | | | |
|---|---|---|---|---|
| 3,938,250 | A | 2/1976 | Perry | |
| 4,302,876 | A | 12/1981 | Emmett | |
| 4,378,634 | A | 4/1983 | Jacobson | |
| 4,389,773 | A | 6/1983 | Nissen et al. | |
| 4,562,644 | A * | 1/1986 | Hitchens | 30/41 |
| 4,875,288 | A * | 10/1989 | Trotta et al. | 30/49 |
| 4,939,840 | A * | 7/1990 | Butka | 30/37 |
| 4,970,784 | A * | 11/1990 | Althaus et al. | 30/527 |
| 6,035,537 | A | 3/2000 | Apprille, Jr. et al. | |
| 6,044,542 | A | 4/2000 | Apprille, Jr. et al. | |
| 6,161,287 | A * | 12/2000 | Swanson et al. | 30/50 |
| 6,948,249 | B2 * | 9/2005 | Barone et al. | 30/41 |
| 7,100,284 | B2 * | 9/2006 | King | 30/49 |
| 7,802,353 | B2 * | 9/2010 | Gratsias et al. | 29/524.1 |
| 2001/0029669 | A1 * | 10/2001 | Ferraro et al. | 30/49 |
| 2003/0159291 | A1 | 8/2003 | Clark | |
| 2010/0170094 | A1 * | 7/2010 | Hayashi | 30/50 |

FOREIGN PATENT DOCUMENTS

| | | | |
|---|---|---|---|
| DE | 25 184 99 | | 11/1975 |
| DE | 3127999 | | 8/1982 |
| DE | 698 16 635 | | 5/2004 |
| DE | 698 28 655 | | 12/2005 |
| EP | 0 064 190 | | 11/1982 |
| EP | 0 321 883 | A | 6/1989 |
| EP | 0 858 869 XY | | 8/1998 |
| EP | 1 531 030 X | | 5/2005 |
| JP | 4-361782 | * | 12/1992 |
| JP | 4-361783 | * | 12/1992 |

* cited by examiner

*Primary Examiner* — Hwei C Payer
(74) *Attorney, Agent, or Firm* — Lucas & Mercanti, LLP; Klaus P. Stoffel

(57) ABSTRACT

A razor blade unit including a blade housing to hold at least one blade with a cutting edge, and a cover connected to the blade housing. The cover faces the back edges of the blades, i.e., the edges opposite from the cutting edges. The blade housing has positioning notches to support the cutting edges. In addition, the cover can have recesses to support the back edges of the blades and an elastic component, which exerts a pressing force on the back edges of the blades.

15 Claims, 3 Drawing Sheets

RAZOR BLADE UNIT WITH CUTTING EDGE SUPPORT

BACKGROUND OF THE INVENTION

The present invention pertains to a razor blade unit for a razor.

Conventional razor blade units for wet shaving usually consist of two frame parts, where the slide strip is arranged on one of the frame parts and the foam edge on the other frame part. In older systems, the blades were riveted into the frame. The increase in the number of blades, however, has made fastening with rivets disadvantageous, because the distance between the rivet holes and the cutting edge increases significantly with each blade. The blades must therefore be processed so that each has a different width, which leads to very wide cutting units, especially in systems with three or more blades. A separate blade geometry is required for each blade position. Another disadvantage of razor blade units produced in this way is that the foam edge and the slide strip are located on different frame parts, so that the parts which determine the skin contact plane must lie within very narrow tolerances with respect to their positioning. Razor blade units with three or more blades are therefore not usually fastened to the frame by rivets any longer.

A razor blade unit in which, during the shaving process, the blades can move up and down in slots against elastic arms in a housing is known from U.S. Pat. No. 4,378,634. Metal clips on the housing hold the blades in the slots and determine the positions of the cutting edges of the blades in the rest position. During production, the blades are first arranged in the housing. Then a U-shaped clip is positioned over the housing and the blades. In the last step, the side pieces of the clip are bent around the bottom area of the housing.

DE 698 28 655 T2 also uses a metal retaining clip to secure the blades which have been attached to the housing. The retaining clip comprises an end piece, which enters into a press-fit with a wedge-shaped section of the housing to make it easier to secure the retaining clip to the housing.

DE 698 16 635 T2 describes a razor unit with a retaining clip of metal to hold the blades. The housing comprises a first lever part, which extends outward over adjacent surface sections located on two sides of the lever part. The retaining clip comprises a first end piece, which has been bent over the first lever part beyond the elasticity limit of the clip. When the first end piece is bent around the first lever part, the lever part is deformed by the exerted pressure, and its height is reduced.

The blades of the razor blade units are usually ground from narrow strips of steel. Because steel is a relatively expensive material, the attempt is made to process strips of the least possible width. To guarantee that the razor blade unit can be rinsed out well, that is, so that the spaces between adjacent blades can be easily rinsed clean, angled blades are usually used in razor systems with three or more blades. The use of angled blades has been known for many years and can be derived from EP 0 064 190, from DE 25 18 499, and from U.S. Pat. No. 4,302,876, for example.

DE 31 27 999 C2 describes a razor with at least one angled blade fastened movably to a main body. Spring fingers, which are supported on the main body, act on the blades. The individual blades assume their desired positioning as a result of the elastic force which the spring fingers exert on the back edges of the blades.

In general, an essential requirement on razor blade units consists in that the cutting edges of the several blades should be positioned precisely with respect to each other and in relation to the skin contact plane. The larger the number of blades in the razor blade unit, the more difficult the positioning. If the cutting edge of one or more blades is not aligned precisely, either there is the danger of injury to the user, or the shaving results are not optimal.

SUMMARY OF THE INVENTION

The goal of the present invention therefore consists in making available an improved razor blade unit, in which a high degree of positioning precision with respect to the cutting edges of the blades is guaranteed in a simple manner. In addition, the pressing or retaining force required to position the blades is to be made available in the simplest possible way. The fewest possible components are to be used to support the blades. The razor blade unit, finally, is to be characterized by a relatively small number of assembly steps and by the lowest possible production cost.

The inventive razor blade unit is characterized in that positioning notches are provided in the side walls of the blade housing, and in that the side ends of the cutting edge of the blade, i.e. the left and right corner areas of the cutting edge, are pushed into these notches until they make direct contact. Recesses are also preferably introduced into the cover, which serve to support the back edges of the blades. It is also advisable according to the invention for the cover to comprise an elastic component, where this elastic component exerts a force on the back edges of the blades and thus presses the cutting edges of the blade into the positioning notches.

An essential advantage of the inventive razor blade unit is that the blades can be supported in a relatively simple manner and that in spite of this it is ensured that the cutting edges of the blades are held in a very precise position. To support the blades, it is necessary only to provide appropriate recesses in the housing and/or in the cover. In addition, the cover must be appropriately designed, so that it can exert a pressing force on the back edges of the blades. The manufacturing tolerances of the blades, which can lead to deviations in the distance between the cutting edge and the back edge of the blade, are compensated at the back edges. Thus it is guaranteed that blade tolerances will have no effect on the desired degree to which the blade projects (protrudes) beyond a predetermined skin contact surface. The positioning notches are arranged in such a way that their inner contact surface defines the desired protrusion of the cutting edge. The positioning notches must be fabricated with high precision, but this does not present a problem when the housing is produced by a plastic injection-molding process. As a result of the pressing force acting on the back edges of the blades, the lateral edge areas, i.e. corners, of the cutting edges are pressed into the positioning notches. As this is happening, the lateral edge areas of the cutting edges usually dig themselves slightly into the housing material, as a result of which it is ensured that the blades can no longer leave their proper positions during the shaving process.

According to an especially preferred embodiment, the elastic component is formed by an elastomeric layer. The use of an elastomeric layer makes it possible to provide in an uncomplicated manner the pressing force required to position the blades. The elastomeric layer is to be adapted with respect to flexibility and application thickness in such a way that the cutting edges are pressed against the housing with the force necessary to hold the blades in place. The pressing force exerted by the cover is selected in such a way that the forces acting on the cutting edges during shaving cannot lead to the displacement of the blades. The cover can be designed as a two-component injection-molded part. Alternatively, the elastic component can also be realized as a separate part and attached to the cover by suitable fastening means.

In an advantageous embodiment, the elastic component is arranged directly adjacent to the recesses in the cover which hold the back edges of the blades. The elastic component extends upward beyond the recesses toward the back edges. As a result, manufacturing tolerances of the blades arising during production can be compensated in an especially simple manner.

It has been found especially favorable for the cover to comprise an aluminum element to serve as a sacrificial anode, which, when the cover is closed, comes in contact with the back edges of the blades. Thus the blades can be easily protected from corrosion. There is therefore no need to apply a coating to the blades to protect them from corrosion. The aluminum element is preferably arranged in the elastic component of the cover. In other embodiments, the aluminum element can also be located in contact with the blades at some other suitable point in the blade housing.

According to another advantageous embodiment, the back cover is provided with a central web, which comprises recesses for supporting the back edges of the blades. The central web thus serves to provide additional support for the blades. In an effective and more highly elaborated embodiment, the elastic component is present at least in the area of the recesses in the central web. The aluminum element functioning as a sacrificial anode can be arranged within the elastic component of the central web.

In an effective embodiment, the housing comprises webs extending toward the cover to serve as mounting aids during the introduction of the blades into the housing. The blades are laid in the guide spaces remaining between the webs and are held in these spaces until the cover is set down in the appropriate position. The webs thus facilitate the assembly of the razor blade unit. In the finished, assembled razor blade unit, the webs no longer have any necessary function, but they do stabilize the blades and prevent them from bending when unusual loads are exerted on them.

It is also advantageous to use angled blades in the razor blade unit. For this purpose, the blades are preferably bent over during the blade production process at an angle of 50-70°. This is not meant to impose a limitation on the range of angles just mentioned, however; other angles are also quite possible. Angled blades can be integrated very effectively into the inventive razor blade unit. Through the use of angled blades, it is ensured that the razor blade unit can be rinsed out thoroughly.

According to another effective embodiment, the razor blade unit comprises a foam edge, arranged in front of the blade (i.e., in front with respect to the shaving direction) to pretension/stretch the skin. It has been found favorable for the foam edge to be realized by a strip of elastic plastic, injection-molded onto the front side of the housing. The foam edge can be fabricated jointly with the housing by a two-component injection-molding process.

Finally, it has also been found to be advantageous for the razor blade unit to be provided with a slide strip, located after the blade (i.e., after with respect to the shaving direction). The slide strip preferably comprises an extension, extending in the longitudinal direction, which is glued or pressed into a corresponding groove in the blade housing. Skin-care substances are preferably contained in the slide strip. The slide strip preferably consists of a water-insoluble matrix and a water-soluble substance combined with the matrix. The water-soluble substance is washed out during the use of the razor. This wash-out can be signaled to the user by way of a suitable indicator (such as a change in color), so that he is informed in good time that the useful life of the razor blade unit is about over and that it is therefore time to replace it.

Additional advantages, details, and elaborations of the present invention can be derived from the following description of a preferred embodiment as illustrated in the drawing.

DETAILED DESCRIPTION OF THE INVENTION

Figure 1:
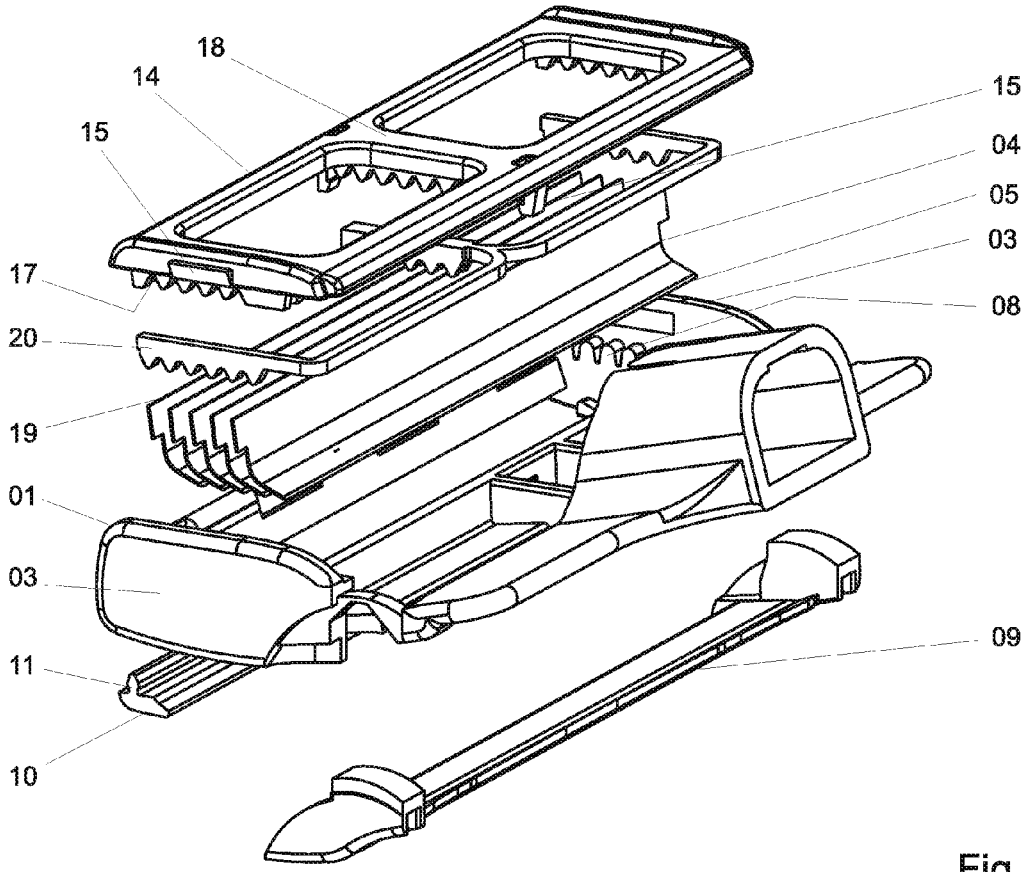
FIG. 1 shows an exploded view of an inventive razor blade unit.

FIG. 1 shows an exploded view of an inventive razor blade unit. An inventive razor blade unit comprises a blade housing 01 to hold the blades 04. In the embodiment shown here, the blade housing 01 serves to hold a total of five blades 04, each of which has a cutting edge 05. Of course, more or fewer blades could also be used in the razor blade unit. In the embodiment shown here, the blades 04 are designed as angled blades. The area comprising the cutting edge 05 is preferably bent over during the blade production process at an angle of approximately 60°.

Figure 2:
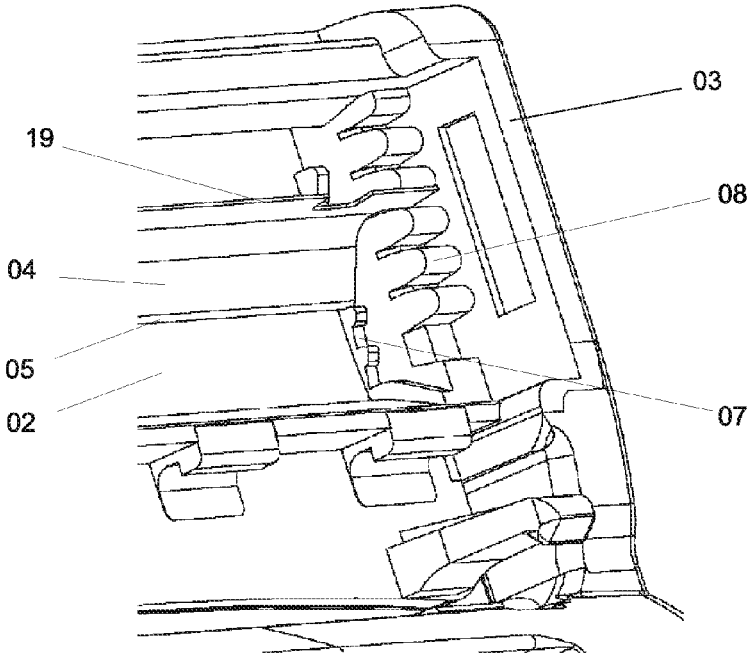
FIG. 2 shows a partial perspective view of the blade housing.

The blade housing 01 leaves a blade window 02 open in its front surface, in which the cutting edges 05 of the blades are exposed, so that they can be brought into contact with the skin during the shaving process. The blade window is bounded on the short sides by side walls 03 of the blade housing. Positioning notches 07 (see FIG. 2) are introduced into the blade housing 01; the corners of the cutting edges 05 engage in these notches. The positioning notches 07 determine the position of the cutting edges relative to the skin contact surface. The stop surfaces in the positioning notches 07 can for this purpose lie in a plane or describe a curved surface. Because the cutting edges 05 of the blades make direct contact with the material of the positioning notches 07, tolerances affecting blade width no longer have any effect on the position of the cutting edges. The stop surfaces of the positioning notches can be made of hard plastic, like the blade housing.

The blade housing 01 is also provided with webs 08, which are used as assembly aids. The individual blades are placed between the webs 08, so that their cutting edges 05 slide into the associated positioning notches 07. The webs 08 do not have to be made with a high degree of precision, because the position of the cutting edges is defined by the positioning notches 07.

A foam edge 09 and a slide strip 10 are also arranged on the blade housing 01 next to the blades 04. The foam edge 09, which serves to pretension the skin to be shaved, consists of an elastomeric plastic and is preferably injection-molded at the same time as the blade housing 01 by means of the two-component injection-molding process. It would also be conceivable, of course, for the loam edge 09 to be a separate component.

The slide strip 10 comes into contact with the skin during the shaving process after the cutting edges 05 of the blades 04. The slide strip 10 contains skin-care substances. The slide strip 10 usually consists of a water-soluble and a water-insoluble component. The water-soluble component, which washes out during the useful life of the razor blade unit, can serve as an end-of-life indicator, which informs the user that the useful life of unit is over. The slide strip 10 is attached to the blade housing preferably by means of an adhesive. In another embodiment, a rectangular extension 11 of the slide strip 10 is glued for this purpose into a corresponding groove 12 (see FIG. 8) in the blade housing 01.

The blade housing 01 is closed off at the rear by a cover 14 (see also FIG. 3), preferably by means of a latching type of connection. For this purpose, either the cover 14 or the blade housing 01 can be equipped with appropriate latching projections 15 and grooves to accept the latching projections 15. The cover 14 is provided with recesses 17, which are located in the side edge areas and in a central web 18. Each of these recesses 17 is preferably V-shaped and serves, in the finished, assembled razor blade unit, to support the back edge 19 of one of the blades, i.e., the area opposite the cutting edge 05 of the blade.

The cover 14 comprises an elastic component 20 (see also FIG. 3), which is preferably arranged in the form of a strip on the inside surface of the cover 14. The elastic component 20 can be produced jointly with the cover 14 by means of the two-component injection-molding process. Alternatively, the elastic component 20 can also be designed as a separate part. The elastic component 20 projects above the recesses 17 and comes to rest against the back edges 19 of the blades. As a result, manufacturing tolerances of the blades 04 associated with the production process can be compensated. The elastic component 20 exerts an elastic pressure on the back edges 19 of the blades. As a result of this pressing force, the cutting edges 05 are pushed into the positioning notches 07 in the blade housing 01. The corners of the cutting edges 05 cut slightly into the positioning notches 07. The force with which the blades 04 are pressed against the blade housing 01 can be influenced by the material (Shore hardness) selected for the elastic component 20 and/or by its application thickness. It must be guaranteed that this force is strong enough to press the cutting edges 05 strongly enough against the blade housing 01 that the blades 04 can no longer leave their positions during the shaving process.

In an alternative embodiment, the elastic component 20 is introduced into the recesses 17 in the cover, or it replaces the recesses completely. During assembly, the back edges 19 of the blades then press themselves into the elastic component and are thus fixed in position.

Figure 3:
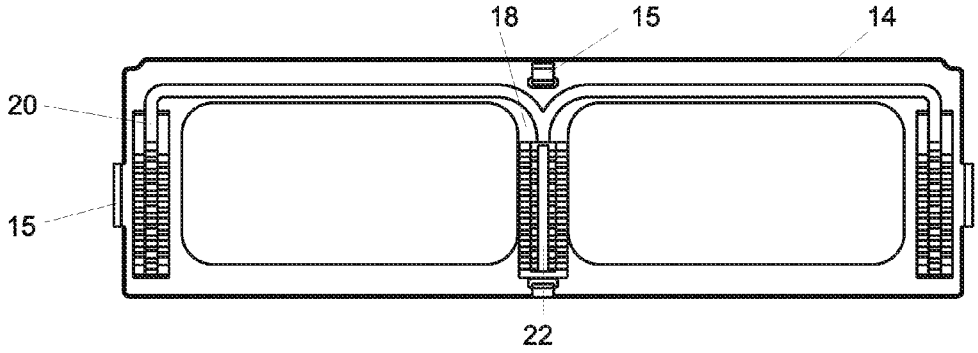
FIG. 3 shows a view of a cover of the inventive razor blade unit.
Figure 6:
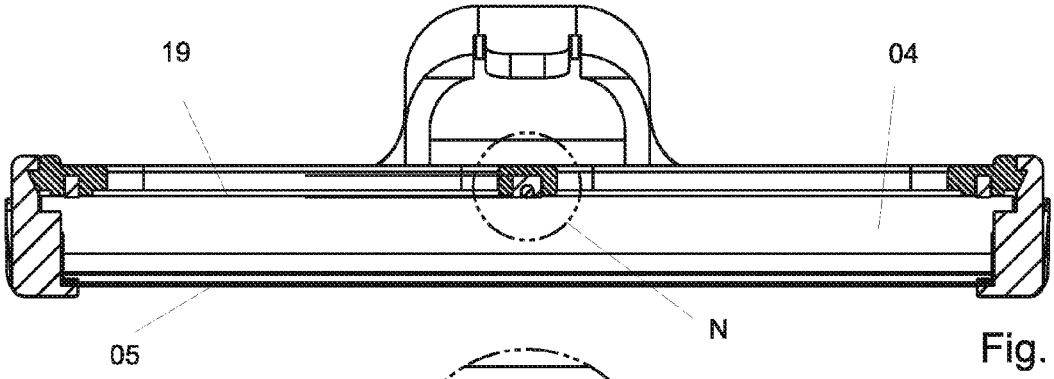
FIG. 6 shows a cross-sectional view of the inventive razor blade unit along line B-B in FIG. 5.
Figure 7:
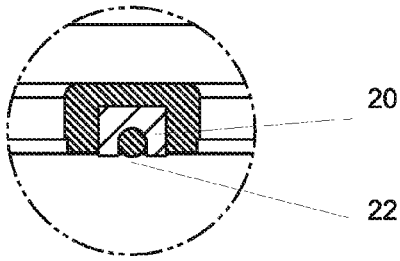
FIG. 7 shows a view of the detail marked "N" in FIG. 6.

For the sake of protection against corrosion, it has been found advantageous for the cover 14 to be provided with an aluminum element 22 serving as a sacrificial anode (see FIG. 3, FIG. 6, FIG. 7). In the embodiment shown here, the aluminum element 22 is an aluminum wire, which is introduced into the area of the elastic component 20 located in the central web 18. In other embodiments, the aluminum wire 22 could be, for example, arranged in the area of the recesses 17 in the lateral edge areas of the cover 14. As a result of the contact of the back edges 19 of the blades 04 with the aluminum wire 22, the blades 04 can be easily protected from corrosion, and this has a positive effect on the useful life of the overall razor blade unit.

The razor blade unit is assembled as follows: First, the slide strip 10 is attached to the blade housing 01. For this purpose, the extension 11 of the slide strip 10 is glued into the groove 12 in the blade housing 01. Then the blades 04 are installed. Each blade 04 is inserted into the blade housing 01 between two webs 08. The blades 04 are thus introduced into the positioning notches 07 of the blade housing 01. After all of the blades 04 have been arranged in the blade housing 01, the latching projections 15 of the cover 14 are latched into the grooves in the blade housing 01. Thus the back edges 19 of the blades are introduced into the recesses 17 in the cover 14, as a result of which they are given the necessary support from the rear. Via the elastic component 20 of the cover 14, a pressing force is exerted on the blades 04. As a result of this pressing force, the cutting edges 05 of the blades 04 are pressed against the blade housing 01, where the corners of the cutting edges 05 can dig themselves slightly into the blade housing 01.

The blades 04 are now held in place in the blade housing in such a way that they can no longer leave their positions as a result of the forces acting on the razor blade unit during the shaving process.

Figure 4:
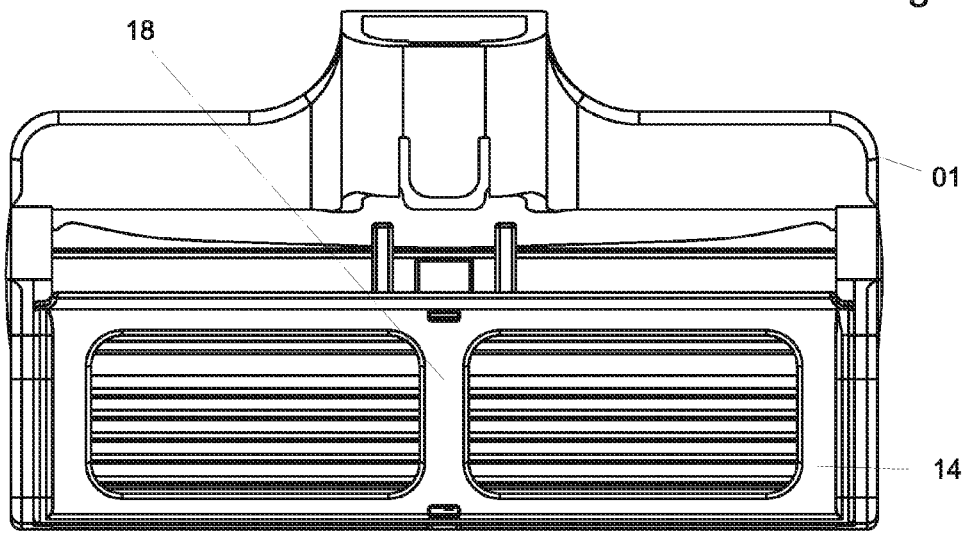
FIG. 4 shows the inventive razor blade unit from the rear.
Figure 5:
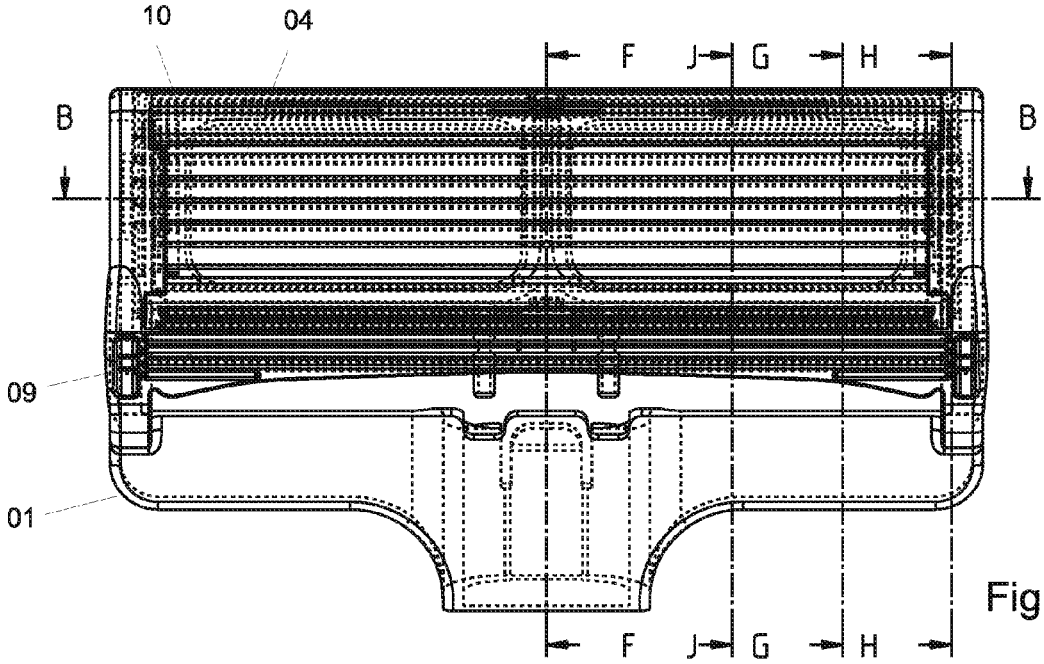
FIG. 5 shows a front view of the inventive razor blade unit with an illustration of the covered body edges.

FIG. 4 shows a view of the finished, fully assembled razor blade unit from the rear. FIG. 5 shows a front view of the finished, fully assembled razor blade unit, where the covered body edges are also illustrated.

Figure 8:
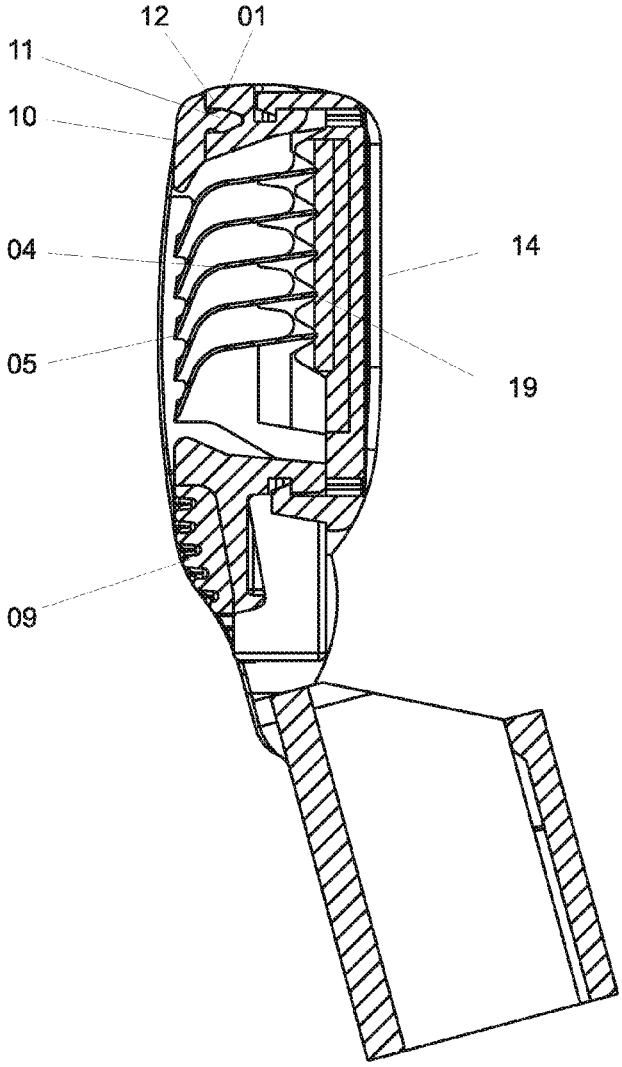
FIG. 8 shows a cross-sectional view of the inventive razor blade unit along line F-F in FIG. 5.

FIGS. 6, 7, and 8 show other views of details of the inventive razor blade unit. The components of the razor blade unit illustrated here have already been explained above.

Although the present invention has been described in relation to particular embodiments thereof, many other variations and modifications and other uses will become more apparent to those skilled in the art. It is preferred, therefore, that the present invention be limited not by the specific disclosure herein, but only by the appended claims.

The invention claimed is:

1. A razor blade unit comprising;

a blade housing with a front blade window and side walls, which form boundaries of the blade window in a longitudinal direction;

a plurality of blades, each with a cutting edge, which is exposed in the area of the blade window; and a rear cover connected to the blade housing so as to face back edges of the blades, that are opposite from the cutting edges, the rear cover having recesses and an elastic component to support the back edges of the blades, wherein positioning notches are provided in the blade housing, lateral ends of the cutting edges of the blades being pushed into the notches due to a pressing force resulting from the elastic component on the back edges of the blades until direct contact is made.

2. A razor blade unit according to claim 1, wherein the positioning notches are provided in the side walls of the blade housing approximately in a plane of the blade window.

3. A razor blade unit according to claim 1, wherein the elastic component is formed by an elastomeric layer, which is provided on an inside surface of the cover.

4. A razor blade unit according to claim 1, wherein the elastic component is arranged adjacent to the recesses in the cover and projects above the recesses toward the back edges of the blades.

5. A razor blade unit according to claim 1, wherein the cover comprises an aluminum element serving as a sacrificial anode.

6. A razor blade unit according to claim 5, wherein the aluminum element is arranged in the elastic component.

7. A razor blade unit according to claim 5, wherein the cover comprises a central web with recesses to support the back edges of the blades.

8. A razor blade unit according to claim 7, wherein the elastic component is arranged at least in an area of the recesses in the central web, the aluminum element being arranged in an area of the elastic component located in the central web.

9. A razor blade unit according to claim 1, wherein the blade housing comprises webs extending toward the cover, between which guide spaces are formed for introduction of the blades, which guide spaces are aligned with the positioning notches.

10. A razor blade unit according to claim 1, wherein the blades are angled blades.

11. A razor blade unit according to claim 1, and further comprising a skin-pretensioning foam edge arranged in front of, with respect to a shaving direction, the cutting edges of the blades.

12. A razor blade unit according to claim 11, wherein the foam edge is a non-water-soluble elastomeric strip of plastic, injection-molded onto a front side of the blade housing.

13. A razor blade unit according to claim 1, and further comprising a slide strip located after, with respect to a shaving direction, the cutting edges of the blades.

14. A razor blade unit according to claim 13, wherein the slide strip comprises an extension extending in a longitudinal direction, the extension being mounted in a groove in the blade housing.

15. A razor blade unit according to claim 14, wherein the extension is glued, pressed or welded in the groove.

* * * * *